US012553208B2

(12) United States Patent
Zhou et al.

(10) Patent No.: US 12,553,208 B2
(45) Date of Patent: Feb. 17, 2026

(54) ROOT-LIKE MECHANICAL FOUNDATION

(71) Applicant: A&C Future Inc., Newport Beach, CA (US)

(72) Inventors: Zhuangboyu Zhou, Santa Ana, CA (US); Ju Gao, Santa Ana, CA (US); Jiuqi Wang, Santa Ana, CA (US); Sichen Li, Santa Ana, CA (US); Xunmin Jiang, Irvine, CA (US); Shoue Chen, Irvine, CA (US); Han Qin, Newport Beach, CA (US); Jiayang Qin, Newport Beach, CA (US)

(73) Assignee: A&C Future Inc

( * ) Notice: Subject to any disclaimer, the term of this patent is extended or adjusted under 35 U.S.C. 154(b) by 573 days.

(21) Appl. No.: 18/106,955

(22) Filed: Feb. 7, 2023

(65) Prior Publication Data

US 2024/0263420 A1 Aug. 8, 2024

(51) Int. Cl.
*E02D 27/50* (2006.01)

(52) U.S. Cl.
CPC ..... *E02D 27/50* (2013.01)

(58) Field of Classification Search
CPC ..... E02D 27/50
See application file for complete search history.

(56) References Cited

U.S. PATENT DOCUMENTS 2,966,243 A * 12/1960 Clapper ..... E02D 5/803 52/161
3,056,477 A * 10/1962 Wooley ..... E02D 5/805 29/239
11,976,434 B2 * 5/2024 Edgerton ..... E04H 12/2215
12,129,622 B2 * 10/2024 Wang ..... E02D 5/56

FOREIGN PATENT DOCUMENTS

CN 118958361 A * 11/2024 ..... E02D 5/801
CN 119195134 A * 12/2024 ..... E02D 13/00
KR 102718151 B1 * 10/2024 ..... F16B 25/0094

* cited by examiner

*Primary Examiner* — Gary S Hartmann
(74) *Attorney, Agent, or Firm* — Elizabeth Yang

(57) ABSTRACT

A mechanical foundation component includes a support ring, a plurality of rotary shafts, a plurality of blades, a plurality of blade gears, a gear ring, a cylindrical housing, and a control rod with a drive gear; the control rod can control the blade fold inside or unfold outside the mechanical foundation component. Several mechanical foundation components form a root-like mechanical foundation. The corresponding control rods control the gears of different mechanical foundation components. The blades can be expanded after the foundation is punched into the ground.

20 Claims, 6 Drawing Sheets

ROOT-LIKE MECHANICAL FOUNDATION

FIELD OF THE INVENTION

The present invention relates to a mechanical foundation for use in construction. More so, the present invention relates to a root-like foundation that has bumping and extendable feet for loading the construction above is introduced herein.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Foundation is an important part of a building construction process which costs a lot of labor and time. In the traditional method, there are different kinds of foundations such as pile foundations, raft foundations, and so on. However, most of them are made of reinforced concrete and the average construction time for the foundation is one month. There is rarely a prefabricated foundation. The problem with existing foundations is the long construction period and the tendency to settle in soft soils, leading to foundation subsidence, which in turn leads to building instability.

To solve the above problems, the present invention is proposed. This invention creates a mechanical foundation that is root-like. The blades will expand out for a larger contact surface with soil. It reduces the chance of settling and increases the foundation building efficiency.

SUMMARY

Illustrative embodiments of the disclosure are generally directed to a mechanical foundation component, a mechanical foundation composed of multiple said mechanical foundation components, and a method that applies the mechanical foundation.

A mechanical foundation component for use in construction may include a support ring; a plurality of rotary shafts, each rotary shaft may be rotatably positioned on the surface of the support ring; a plurality of blades, each blade may be mounted on each rotary shaft and rotate with the rotary shaft; a plurality of blade gears, each blade gear may be fixed to each rotary shaft and rotate with each rotary shaft and each blade; a gear ring engaging with all the blade gears and driving the blade gears to rotate at a same angular velocity, wherein the gear ring may be coaxial to the supporting ring; a cylindrical housing having a top wall, an inner cylinder extending downward from the top wall, and an outer wall extending down along circumference of the top wall, wherein the inner cylinder may be securely connected to the support ring, and the outer wall may cover the blade gears and the gear ring; and a control rod with a drive gear, wherein the drive gear may engage with one of the blade gears, and axis of the control rod may be parallel to axis of the support ring.

Each blade may have a mounting end mounted on each rotary shaft, and a cutting end may be driven to rotate toward inside or outside the mechanical foundation component.

The edges of the blades may be chamfered and the surface of the blades may be bumping.

The bottom surface of the top wall may be provided with a plurality of blind holes to accommodate rotary shafts. The top wall may have a first through hole to accommodate the control rod. The support ring may have a second through hole or a blind hole to accommodate the control rod.

Each blade gear may extend upward in direction of the axis of each blade gear to form a blade gear shaft; bottom surface of the top wall may be provided with a plurality of blind holes to accommodate blade gear shafts.

The rotary shafts may be distributed in equal radians along circumference of the support ring.

A mechanical foundation is also provided. The mechanical foundation may include mechanical foundation components that have the same configuration as the mechanical foundation component mentioned above. The mechanical foundation components are the top mechanical foundation component and the bottom mechanical foundation component. The support ring of the top mechanical foundation component may be mounted on the cylindrical housing of the bottom mechanical foundation component.

The control rod corresponding to each mechanical foundation component may be distributed in equal radians along the circumference of the mechanical foundation.

Each top wall of each cylindrical housing may have first through holes to accommodate each control rod.

The support ring of the top mechanical foundation component and the support ring of the middle mechanical foundation component each may have second through holes to accommodate each control rod.

At least one mechanical foundation components have the same structure as the mechanical foundation component mentioned above may be set up between the top mechanical foundation component and the bottom mechanical foundation component along vertical direction. The support ring of the mechanical foundation component located relatively upper might be mounted on cylindrical housing of immediately lower mechanical foundation component.

A method of construction using a mechanical foundation may include:

a. providing a mechanical foundation as mentioned above; and,
b. punching the mechanical foundation into ground;
c. driving the blades of each mechanical foundation component to extend outward from inside of the mechanical foundation.

When driving blades of the same mechanical foundation component, each blade may turn at the same angle synchronously. The blades of different mechanical foundation components may rotate synchronously or asynchronously. The blades of different mechanical foundation components may extend outward at same or different angle.

These, as well as other components, steps, features, objects, benefits, and advantages, will now become clear from a review of the following detailed description of illustrative embodiments, the accompanying drawings, and the claims.

Other systems, devices, methods, features, and advantages will be or become apparent to one with skill in the art upon examination of the following drawings and detailed descriptions. It is intended that all such additional systems, methods, features, and advantages be included within this description, be within the scope of the present disclosure, and be protected by the accompanying claims and drawings.

BRIEF DESCRIPTION OF THE DRAWINGS

The drawings illustrate examples. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

FIG. 2A is a front view. FIG. 2B is a schematic view.

FIG. 3A illustrates the status that all the blades are folded. FIG. 3B illustrates the status that all the blades are unfolded.

The same reference numerals refer to the same parts throughout the various views of the drawings.

DETAILED DESCRIPTION OF ILLUSTRATIVE EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1A:
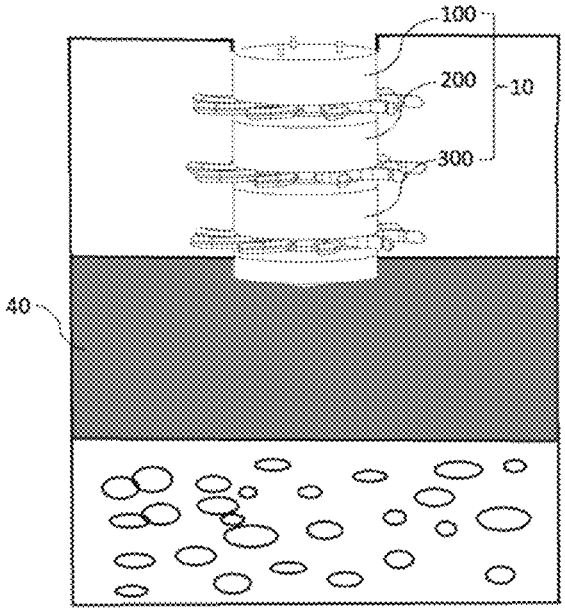
FIG. 1A and FIG. 1B illustrate how the root-like mechanical foundation works inside the soil and a schematic view of the mechanical foundation when all blades are unfolded.
Figure 1B:
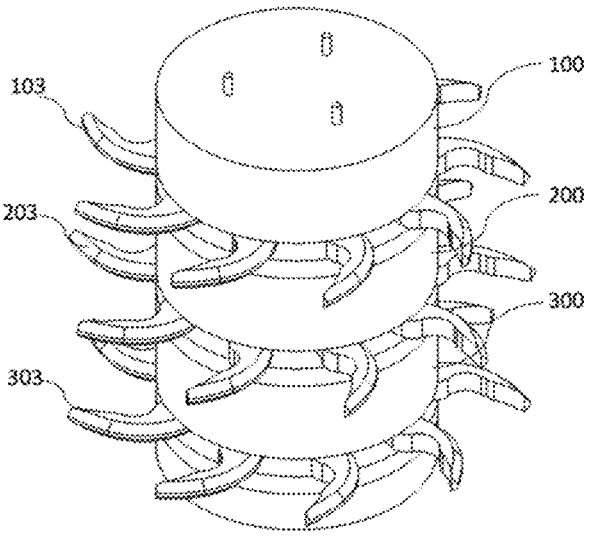

FIG. 1A and FIG. 1B illustrate how the root-like mechanical foundation works inside the soil and a schematic view of the mechanical foundation when all blades are unfolded.

The mechanical foundation can have only one mechanical foundation component, or the mechanical foundation can be composed of multiple mechanical foundation components that have the same configurations.

The mechanical foundation can also have two mechanical foundation components. In this scenario, the mechanical foundation components are the top mechanical foundation component and the bottom mechanical foundation component. The support ring of the top mechanical foundation component may be mounted on the cylindrical housing of the bottom mechanical foundation component.

The mechanical foundation can also have one or more middle mechanical foundation component between the top and the bottom mechanical foundation components. FIGS. 1A, 1B, 2A, 2B, 5A, 5B, 8A, 8B, 8C illustrate one middle mechanical foundation component as examples.

The mechanical foundation 10 is composed of three components, i.e., the top mechanical foundation component 100, the middle mechanical foundation component 200, and the bottom mechanical foundation component 300. After the blades 103, 203, and 303 expand, they will insert into soil 40 as the fibrous roots of a tree. The whole mechanical foundation 10 looks like a root of a tree. Thus, the mechanical foundation 10 is a root-like foundation. The top of the top mechanical foundation component 100 may cover with a platform depending on the upper structure. The bottom of the bottom mechanical foundation component 300 may be connected a ground drilling unit such as a drill. As shown in the drawings, the root-like mechanical foundation 10 has a relatively larger contact surface with soil 40. Therefore, it reduces the pressure on the soil when loading for the same quantity.

Figure 2A:
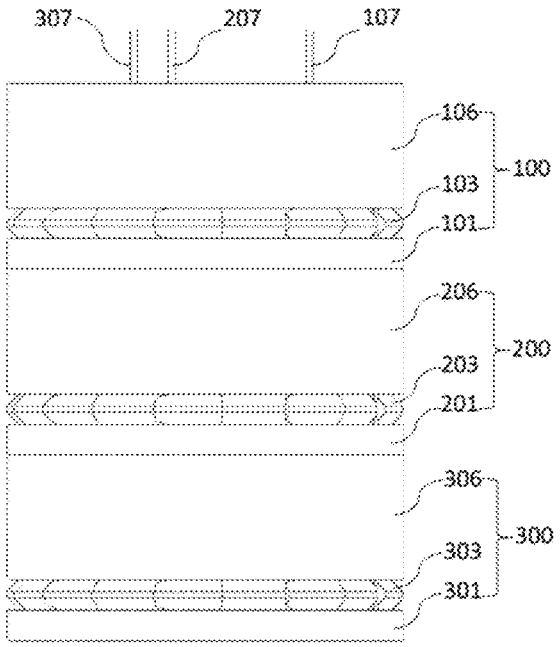
FIG. 2A and FIG. 2B illustrate the initial status that all blades are folded inside the mechanical foundation.
Figure 2B:
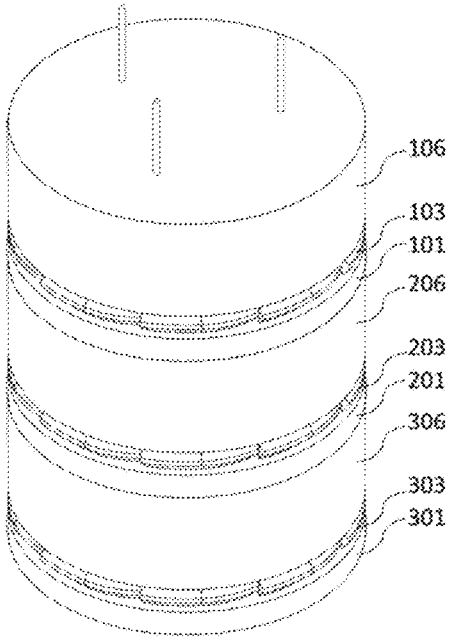

FIG. 2A and FIG. 2B illustrate the initial status that all blades are folded inside the mechanical foundation 10. FIG. 2A is a front view. FIG. 2B is a schematic view. Before being driven into the ground, all the blades are folded inside the mechanical foundation 10 to reduce the resistance when entering the ground. After being driven into the ground at the designated location, all blades are unfolded to increase the stability of the foundation as FIG. 1A shows.

Figure 3A:
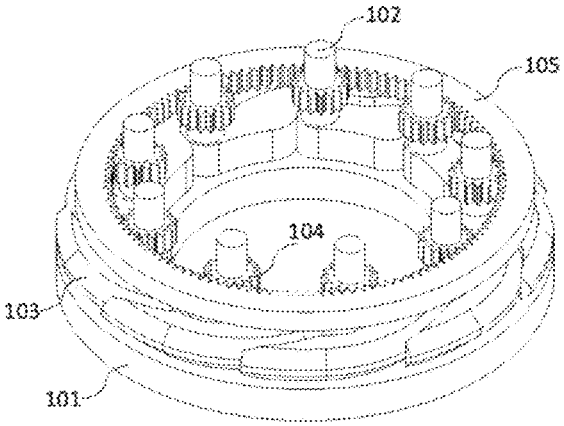
FIG. 3A and FIG. 3B illustrate the internal setup of the mechanical foundation component.
Figure 3B:
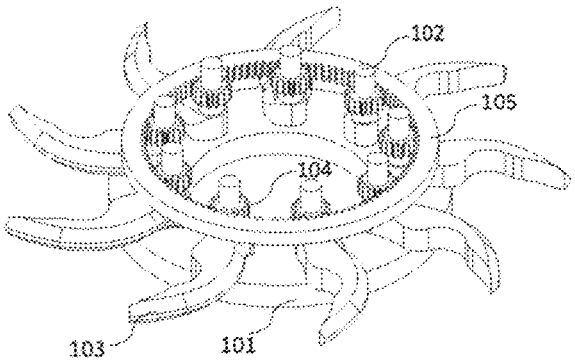

FIG. 3A and FIG. 3B illustrate the internal setup of the mechanical foundation component 10. FIG. 3A illustrates the status that all the blades 103 are folded. FIG. 3B illustrates the status that all the blades 103 are unfolded.

Figure 8A:
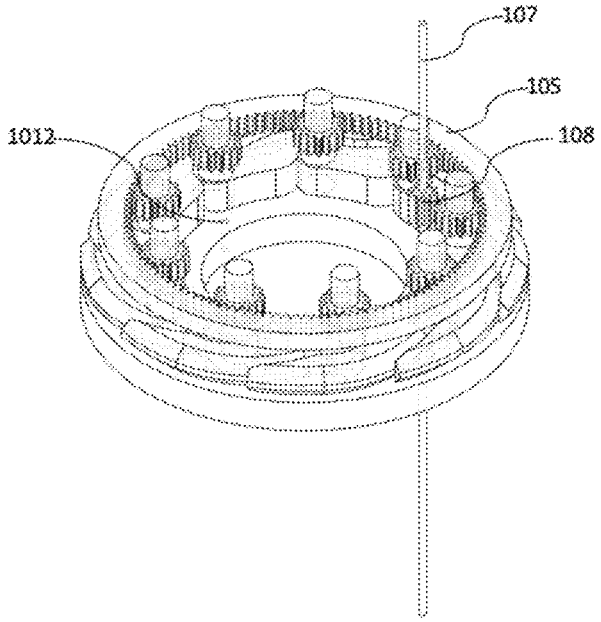
FIG. 8A is the schematic view of the mechanical foundation component (the cylindrical housing is not shown).

The mechanical foundation component 100 for use in construction includes a support ring 101; a plurality of rotary shafts 102, each rotary shaft 102 is rotatably positioned on the surface of the support ring 102; a plurality of blades 103 are mounted on the rotary shafts 102 and rotate with the rotary shaft 102; a plurality of blade gears 104 are fixed to the rotary shaft 102 and rotate with the rotary shafts 104 and the blades 103; a gear ring 105 engages with all the blade gears 104 and drives all the blade gears 104 to rotate at a same angular velocity. The gear ring 105 is coaxial to the supporting ring 101. The gear ring 105 is engaged with the drive gear 108 on the control rod 107 (not shown in FIG. 3A and FIG. 3B, the control rod 107 with the drive gear 108 is shown in FIG. 8A and FIG. 9B). The rotation of the control rod 107 can be driven and controlled by an external drive, such as a motor (not shown).

The rotation of the control rod 107 generates the rotation of the drive gear 108. The drive gear 108 drives one of the blade gear 104 with which it engages to rotate; the blade gear 104 drives the gear ring 105. The rotation of gear ring 105 drives the synchronized rotation of all the other blade gears 104 with which it engages. Each blade gear 104 and blade 103 is fixed to each other, and both rotate around their respective rotary shaft 102. Thus, the rotation of the control rod 107 drives and controls the rotation of the blades 103. Further, the rotation of the control rod 107 can enable the blades 103 to turn inside or outside the mechanical foundation component 100 as needed.

Figure 4A:
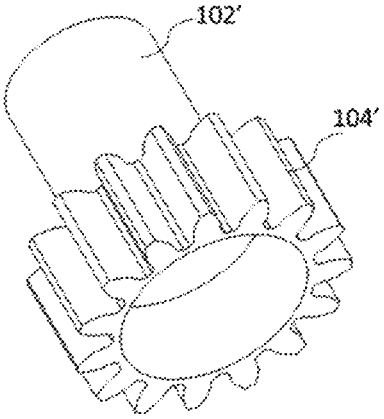
FIG. 4A illustrates the blade gear with a blade gear shaft.
Figure 4B:
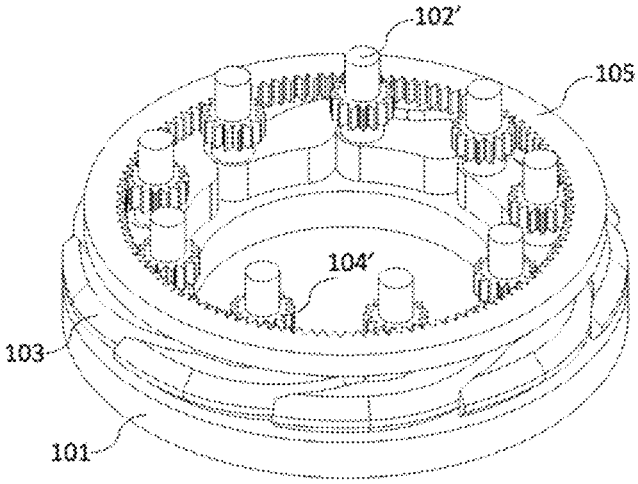
FIG. 4B illustrates a schematic view of a mechanical foundation component with blade gear shafts.

FIG. 4A illustrates the blade gear with a blade gear shaft; FIG. 4B illustrate a schematic view of a mechanical foundation component with blade gear shafts.

Each blade gear 104' extends upward in direction of the axis of each blade gear 104' to form a blade gear shaft 102'. The inner wall of each blade gear 104' joins and rotates integrally with the part of the outer cylindrical surface of each rotary shaft 102 that overlaps. Accordingly, the shaft 102' rotates synchronously with the shaft 102.

The drive gear 108 drives one of the blade gear 104' with which it engages to rotate; the blade gear 104' drives the gear ring 105. The rotation of gear ring 105 drives the synchronized rotation of all the other blade gears 104' with which it engages. Each blade gear 104' and blade 103 is fixed to each other, and both rotate around their respective rotary shaft 102 and the blade gear shaft 102'. Thus, the rotation of the control rod 107 drives and controls the rotation of the blades 103. Further, the rotation of the control rod 107 can enable the blades 103 to turn inside or outside the mechanical foundation component 100 as needed.

In another embodiment (not shown in drawings), the rotation of the control rod generates the rotation of the drive gear. The drive gear drives the gear ring, with which it engages to rotate. The rotation of gear ring drives the synchronized rotation of all the blade gears with which it engages. Each blade gear and blade are fixed to each other, and both rotate around their respective rotary shaft. Thus, the rotation of the control rod drives and controls the rotation of the blades.

Figure 5A:
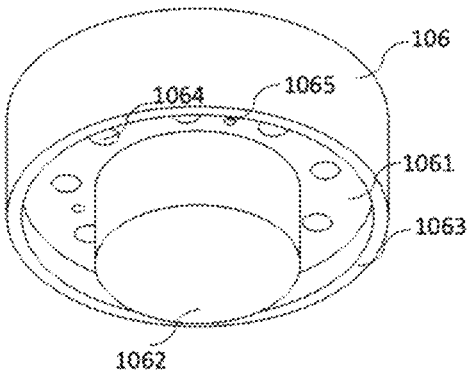
FIG. 5A is the schematic view of the cylindrical housing.
Figure 5B:
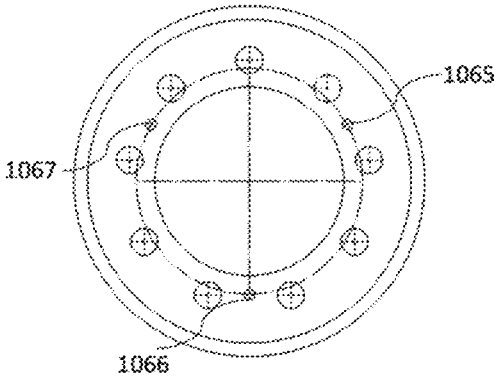
FIG. 5B is the bottom view of the cylindrical housing.

The mechanical foundation component 100 further has a cylindrical housing 106 to protect the gears 103 and other inner structures. FIG. 5A is the schematic view of the cylindrical housing. FIG. 5B is the bottom view of the cylindrical housing. The cylindrical housing 106 has a top wall 1061, an inner cylinder 1062 extending downward from the top wall 1061, and an outer wall 1063 extending down along circumference of the top wall 1061. The inner cylinder 1062 is securely connected to the support ring 101. This results in a sturdy structure. The outer wall 1063 covers the blade gears 103 and the gear ring 105. This protects the internal structure from dirt ingress causing seizure. The bottom surface of the outer wall 1063 is higher than the upper surface of the support ring 101 in the vertical direction. The height difference between the two surfaces allows blades 103 to freely rotate inside or outside the mechanical foundation component 100.

As FIG. 5A and FIG. 5B show, the bottom surface of the top wall 1061 is provided with a plurality of blind holes 1064 to accommodate rotary shafts 102 or the blade gear shaft 102'. The top wall 1061 has a first through hole 1065 to accommodate the control rod 107. When the mechanical foundation 10 is composed of three mechanical foundation components 100, 200, and 300, each top wall of the mechanical foundation components will have first through holes to accommodate the control rods. In FIG. 5A and FIG. 5B, two more first through holes 1066 and 1067 are illustrated.

Figure 6A:
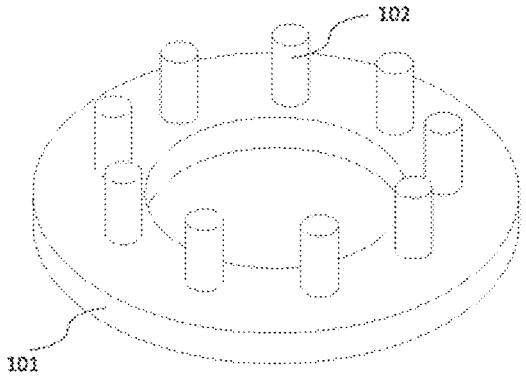
FIG. 6A is the schematic view of the supporting ring with rotary shafts.
Figure 6B:
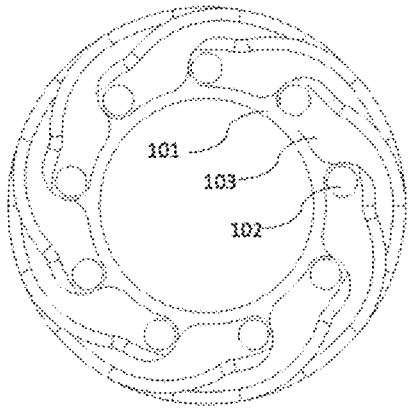
FIG. 6B is the top view of the supporting ring with rotary shafts and blades.

FIG. 6A is the schematic view of the supporting ring with rotary shafts. FIG. 6B is the top view of the supporting ring with rotary shafts and blades. In folded status, all the blades are inside the mechanical foundation component 100. As a result, it is easy to transport and will reduce resistance when drilling into the land, facilitating fast drilling. The rotary shafts 102 are distributed in equal radians along the circumference of the support ring 101. As a result, the individual blades 103 are subjected to the same forces, improving the mechanical foundation's overall life.

Figure 7A:
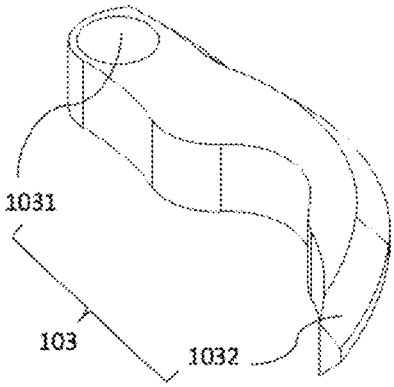
FIG. 7A is the schematic view of a blade.
Figure 7B:
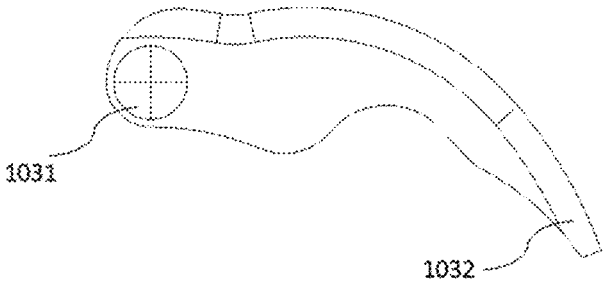
FIG. 7B is the top view of a blade.

FIG. 7A is the schematic view of a blade. FIG. 7B is the top view of a blade. Each blade 103 has a mounting end with a mounting hole 1031 mounted on each rotary shaft 102, and a cutting end 1032 is driven to rotate toward inside or outside the mechanical foundation component 100. Edges of blade 103 are chamfered. This makes blade 103 easier to cut into the soil when the blades are turned outside. In another embodiment, the surface of the blades is bumping. This provides the advantage that when the blade 103 reaches the designated position and enters the working state, the bumping surface can provide greater friction to make the mechanical foundation more stable.

Figure 8B:
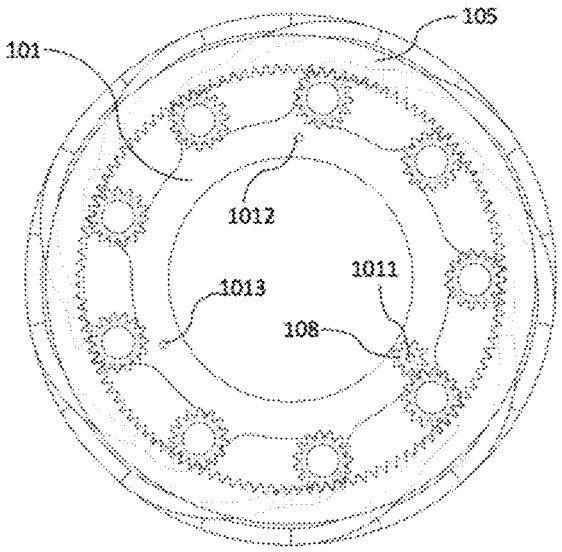
FIG. 8B is the top view of the mechanical foundation component (the cylindrical housing and the control rod are not shown).

FIG. 8A is the schematic view of the mechanical foundation component (the cylindrical housing is not shown). FIG. 8B is the top view of the mechanical foundation component (the cylindrical housing and the control rod 107 are not shown). The support ring 102 has a through hole 1011 or a blind hole (not shown) to accommodate the control rod 107.

When the mechanical foundation 10 is composed of three mechanical foundation components 100, 200, and 300, the support ring of the top and the middle mechanical foundation components will have three first through holes to accommodate the control rods. The support ring of the bottom mechanical foundation component will have three second through holes or three blind holes to accommodate the control rods. In FIG. 8A and FIG. 8B, two more second through holes 1012 and 1013 are illustrated.

Figure 9A:
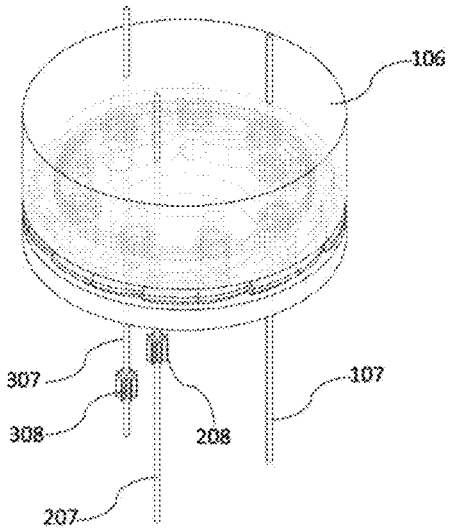
FIG. 9A is the schematic view of the top mechanical foundation component in the mechanical foundation (the middle and bottom mechanical foundation components are not shown).
Figure 9B:
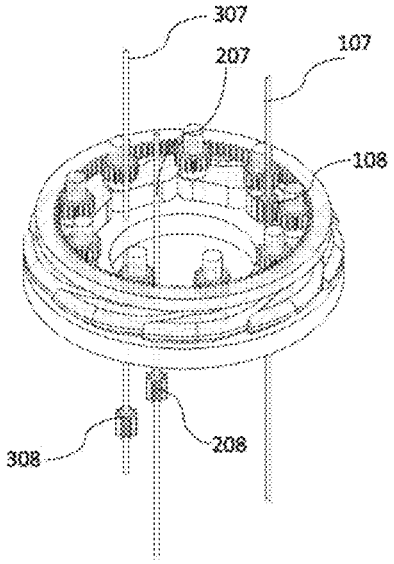
FIG. 9B is the schematic view of the top mechanical foundation component in the mechanical foundation (the cylindrical housing of the top mechanical foundation component is not shown; the middle and bottom mechanical foundation components are not shown).
Figure 9C:
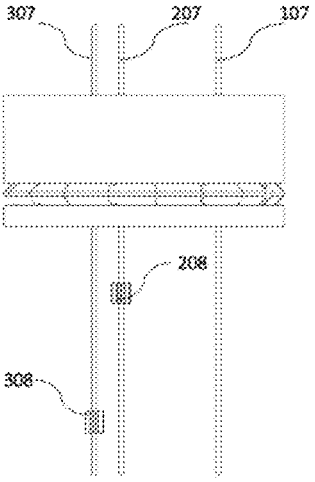
FIG. 9C is the front view of the top mechanical foundation component in the mechanical foundation (the middle and bottom mechanical foundation components are not shown).

FIG. 9A is the schematic view of the top mechanical foundation component in the mechanical foundation (the middle and bottom mechanical foundation components are not shown). FIG. 9B is the schematic view of the top mechanical foundation component in the mechanical foundation (the cylindrical housing of the top mechanical foundation component is not shown; the middle and bottom mechanical foundation components are not shown). FIG. 9C is the front view of the top mechanical foundation component in the mechanical foundation (the middle and bottom mechanical foundation components are not shown). In FIGS. 8A, 8B, and 8C, the control rod 107 of the top mechanical foundation component 100, the control rod 207 of the middle mechanical foundation component 200, and control rod 307 of the bottom mechanical foundation component 300 are shown. Corresponding drive gears 108, 208, and 308 are also shown in FIG. 9B. The three drive gears 108, 208, and 308 independently control the folding or unfolding of the blades 103, 203, and 303 on the three mechanical foundation components 100, 200, and 300, thus enabling greater flexibility. FIG. 6 illustrates the cover platform of the mechanical foundation. The foundation 10 further includes a platform 400 set on top of the topmost cylinder 100; the platform 400 includes: a first cylindrical portion 410; and a second cylindrical portion 420; both the first cylindrical portion 410 and the second cylindrical portion 420 are co-axial with the cylinder 100; the lower surface 4110 of the first cylindrical portion is recessed upward to form a cylindrical space with an annular wall 4120; the second cylindrical portion 420 is mounted on the lower surface 4110 of the first cylindrical portion 410 and extends downward; the lower surface 4110 of the first cylindrical portion is provided with a plurality of blind holes 4130 for holding the mounting shafts 250; the second cylindrical section further includes at least one control rod through-hole 4210.

Refer to FIG. 2A and FIG. 2B. The mechanical foundation 10 is composed of a top mechanical foundation component 100, a middle mechanical foundation component 200 and a bottom mechanical foundation 300, the top mechanical foundation component 100, the middle mechanical foundation component 200, and the bottom mechanical foundation component 300 are connected in order from top to bottom. Each mechanical foundation component has the same structure as mentioned above. The top mechanical foundation component 100 includes a support ring 101, a plurality of rotary shafts (not shown), a plurality of blades 103, a plurality of blade gears (not shown), a gear ring (not shown), a cylindrical housing 106, and a control rod 107 with a drive gear (not shown); the middle mechanical foundation component 200 includes a support ring 201, a plurality of rotary shafts (not shown), a plurality of blades 203, a plurality of blade gears (not shown), a gear ring (not shown), a cylindrical housing 206, and a control rod 207 with a drive gear (not shown); the bottom mechanical foundation component 300 includes a support ring 301, a plurality of rotary shafts (not shown), a plurality of blades 303, a plurality of blade gears (not shown), a gear ring (not shown), a cylindrical housing 306, and a control rod 307 with a drive gear (not shown).

The control rods 107, 207, and 307 go through all the mechanical foundation components 100, 200, and 300. On each mechanical foundation component, there is a corresponding drive gear 108, 208, or 308 to control the folding or unfolding of the blades 103, 203, or 303.

The support ring 101 of the top mechanical foundation component 100 is mounted on cylindrical housing 206 of the middle mechanical foundation component 200; the support ring 201 of the middle mechanical foundation component 200 is mounted on cylindrical housing 306 of the bottom mechanical foundation component 300.

A method of using the mechanical foundation 10 is also provided. The method comprises the following steps:

a. provide a mechanical foundation 10;

b. punch the mechanical foundation 10 into ground;

c. drive the blades 103, 203 and 303 of each mechanical foundation components 100, 200, and 300 to extend outward from inside of the mechanical foundation 10.

When driving blades of the same mechanical foundation component, each blade turns at the same angle synchronously. Blades of different mechanical foundation components rotate synchronously or asynchronously. Blades of different mechanical foundation components extend outward at the same or different angles as needed.

The mechanical foundation can have more than three mechanical foundation components. In this scenario, multiple middle mechanical foundation components can be added as needed. The mechanical foundation can also have one or more at least one mechanical foundation components that have the same structure set up between the top mechanical foundation component and the bottom mechanical foundation component along vertical direction. The support ring of the mechanical foundation component located relatively upper might be mounted on cylindrical housing of immediately lower mechanical foundation component.

The number of control rods is the same as the total number of mechanical foundation components. The number of first through holes of each top wall and the number of second through holes or blind holes of each support ring is also the same as the number of the mechanical foundation components.

The components, steps, features, objects, benefits, and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objects, benefits, and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

Except as otherwise stated immediately above, nothing that has been stated or illustrated is intended or should be interpreted to cause a dedication of any component, step, feature, object, benefit, advantage, or equivalent to the public, regardless of whether it is recited in the claims.

The terms and expressions used herein have the ordinary meaning accorded to such terms and expressions in their respective areas, except where specific meanings have been set forth. Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element proceeded by "a" or "an" does not, without further constraints, preclude the existence of additional elements of the identical type.

What is claimed is:

1. A mechanical foundation component comprising:

a support ring;

a plurality of rotary shafts, each rotary shaft is rotatably positioned on surface of the support ring;

a plurality of blades, each blade is mounted on each rotary shaft and rotates with the rotary shaft;

a plurality of blade gears, each blade gear is fixed to each rotary shaft and rotates with each rotary shaft and each blade;

a gear ring engaging with all the blade gears and driving the blade gears to rotate at same angular velocity, wherein the gear ring is coaxial to the supporting ring;

a cylindrical housing having a top wall, an inner cylinder extending downward from the top wall, and an outer wall extending down along circumference of the top wall, wherein the inner cylinder is securely connected to the support ring, and the outer wall covers the blade gears and the gear ring; and a control rod with a drive gear, wherein the drive gear engages with one of the blade gears, and axis of the control rod is parallel to axis of the support ring.

2. The mechanical foundation component of claim 1, wherein each blade has a mounting end mounted on each rotary shaft, and a cutting end is driven to rotate toward inside or outside the mechanical foundation component.

3. The mechanical foundation component of claim 1, wherein edges of the blades are chamfered.

4. The mechanical foundation component of claim 1, wherein surface of the blades is bumping.

5. The mechanical foundation component of claim 1, wherein bottom surface of the top wall is provided with a plurality of blind holes to accommodate rotary shafts.

6. The mechanical foundation component of claim 1, wherein each blade gear extends upward in direction of the axis of each blade gear to form a blade gear shaft.

7. The mechanical foundation component of claim 6, wherein bottom surface of the top wall is provided with a plurality of blind holes to accommodate blade gear shafts.

8. The mechanical foundation component of claim 1, wherein the top wall has a first through hole to accommodate the control rod.

9. The mechanical foundation component of claim 8, wherein the support ring has a second through hole to accommodate the control rod.

10. The mechanical foundation component of claim 1, wherein the rotary shafts are distributed in equal radians along circumference of the support ring.

11. A mechanical foundation comprising:

a top mechanical foundation component of claim 1; and, a bottom mechanical foundation component of claim 1; wherein, support ring of the top mechanical foundation component is mounted on cylindrical housing of the bottom mechanical foundation component.

12. The mechanical foundation of claim 11, wherein control rod corresponding to each mechanical foundation component is distributed in equal radians along circumference of the mechanical foundation.

13. The mechanical foundation of claim 12, wherein each top wall of each cylindrical housing has first through holes to accommodate each control rod.

14. The mechanical foundation of claim 13, wherein the support ring of the top mechanical foundation component and the support ring of the bottom mechanical foundation component each have second through holes to accommodate each control rod.

15. The mechanical foundation of claim 12, wherein at least one mechanical foundation component of claim 1 is set up between the top mechanical foundation component and the bottom mechanical foundation component along vertical direction.

16. The mechanical foundation of claim 15, wherein support ring of the mechanical foundation component located relatively upper is mounted on cylindrical housing of immediately lower mechanical foundation component.

17. A method of using a mechanical foundation comprising:

a. providing a mechanical foundation of claim 11, b. punching the mechanical foundation into ground; and, c. driving the blades of each mechanical foundation component to extend outward from inside of the mechanical foundation.

18. The method of claim 17, wherein when driving blades of same mechanical foundation component, each blade turns at same angle synchronously.

19. The method of claim 17, wherein blades of different mechanical foundation components rotate synchronously or asynchronously.

20. The method of claim 17, wherein blades of different mechanical foundation components extend outward at same or different angle.

* * * * *